United States Patent [19]

Rush

[11] 3,960,073

[45] June 1, 1976

[54] MACHINE FOR DECORATING TWO-PIECE CANS

[75] Inventor: John E. Rush, Geneva, N.Y.

[73] Assignee: American Can Company, Greenwich, Conn.

[22] Filed: Mar. 10, 1975

[21] Appl. No.: 557,006

[52] U.S. Cl. ..... 101/40; 198/22 R; 427/407; 118/66

[51] Int. Cl.[2] ..... B41F 17/08

[58] Field of Search ..... 101/38 R, 38 A, 39, 101/40, 248, 349–351; 198/22 R, 22 B, 25; 427/402, 407, 372; 118/46, 66

[56] References Cited

UNITED STATES PATENTS

| | | | |
|---|---|---|---|
| 2,399,630 | 5/1946 | Friden | 101/38 A |
| 2,764,933 | 10/1956 | Hargrave | 101/38 R |
| 3,226,850 | 8/1943 | Gladfelter et al. | 101/40 |
| 3,502,195 | 3/1970 | Benner | 198/25 X |
| 3,548,745 | 12/1970 | Sirvet et al. | 198/25 |
| 3,613,571 | 10/1971 | Russell et al. | 101/40 |
| 3,645,201 | 2/1972 | Jackson | 101/38 A |
| 3,661,282 | 5/1972 | Buhayar et al. | 101/40 X |
| 3,710,712 | 1/1973 | Demierre | 101/39 |
| 3,786,747 | 1/1974 | Szpitalak | 101/40 X |
| 3,850,096 | 11/1974 | Taniguchi | 101/40 |

*Primary Examiner*—E. H. Eickholt
*Attorney, Agent, or Firm*—Robert P. Auber; Ira S. Dorman; Eliot S. Gerber

[57] ABSTRACT

A machine for the continuous overlay printing (color-on-color decorating) of cylindrical cans provides for the laying down of base coats on the can prior to the ink lay downs as well as a top coat after the inks are set in a sequence of operations which are performed at a plurality of operating stations arranged in a vertically aligned circle. The cans are conveyed to the machine and are held on mandrels which are arranged in a circle on a rotatable vertical index table and the cans are rotated about their individual axes and rotated by the table to the operating stations in discrete indexed steps.

17 Claims, 12 Drawing Figures

FIG. 12
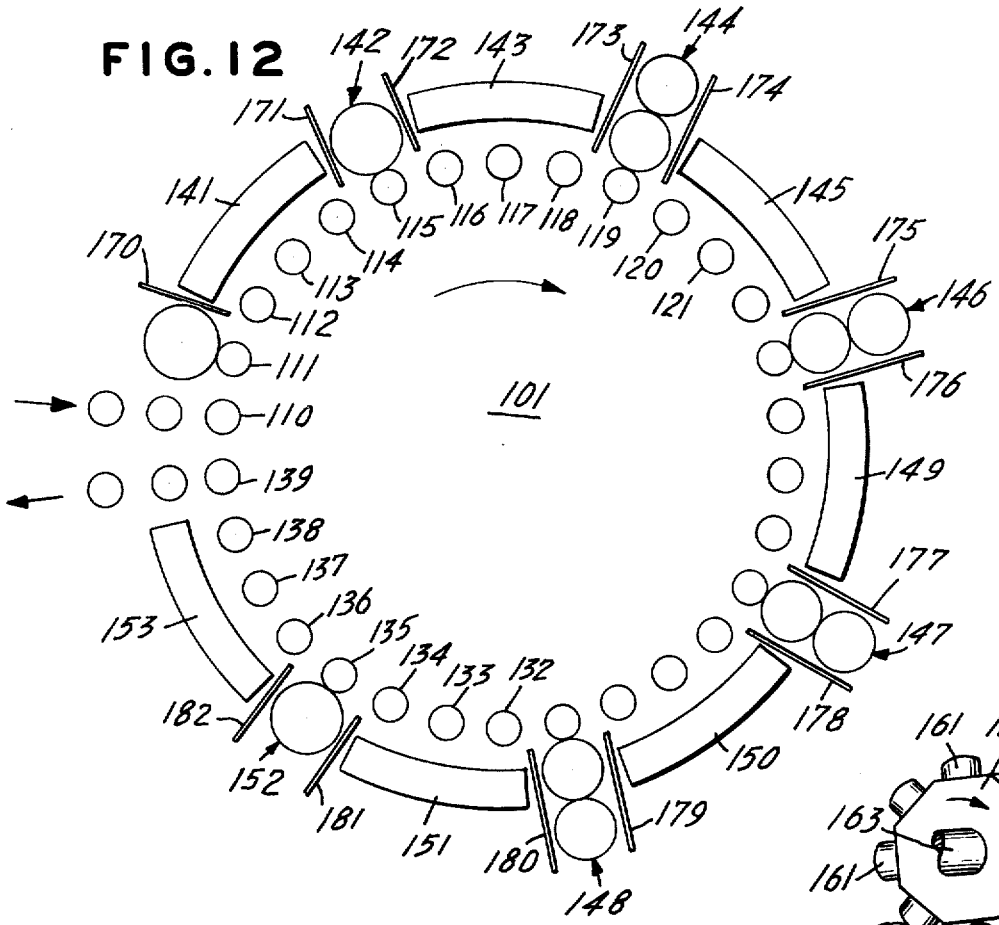
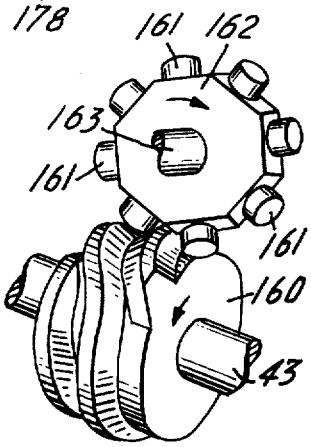
FIG. 11
FIG. 5
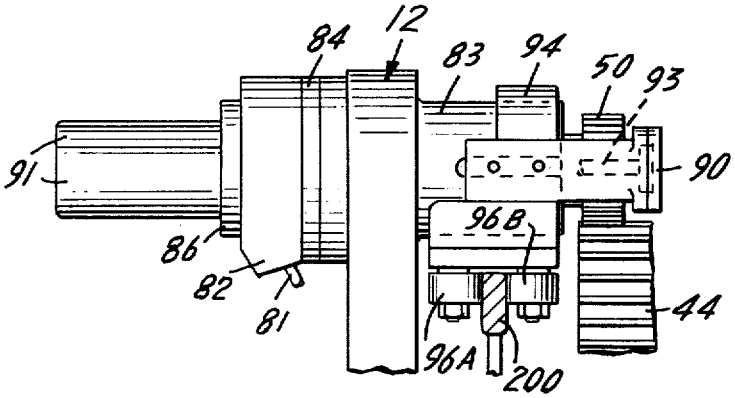

MACHINE FOR DECORATING TWO-PIECE CANS

BACKGROUND OF THE INVENTION

The present invention relates to an improved machine for the continuous decorating of the exterior side walls of cylindrical cans.

More particularly, this invention relates to a machine for decorating the cylindrical body of a two-piece can with color-on-color or overlay printing.

One traditional process of decorating cans has been used with the three-piece cans in which the can consists of a bottom disk, a cylindrical side wall and a top disk, all of which are joined together. The side wall or "body" of the can is printed or otherwise decorated when it is in the form of a flat linear sheet prior to fabrication into a cylinder. A two-piece can is usually drawn from aluminum or steel or other ductile metal into a cylinder form which is integral with a bottom closure portion. The top cap is applied in a subsequent operation. The side wall of the conventional two-piece can is never in a flat sheet form suitable for printing upon. Canning plants frequently prefer to decorate directly upon the outer surface of a cylindrical body of a two-piece can after it is formed into cylindrical form, but prior to subsequent filling of the canned material, rather than use the decoration of a separate paper label which may be pasted to the two-piece can.

Various types of rotary printing machines, generally using solvent inks and separate curing ovens, are known for printing directly upon cans. However, the printing machines and required curing ovens are relatively expensive in capital cost, they are generally costly to operate in terms of energy usage, and they occupy a relatively large amount of factory floor space. Also, for those can decorations that require a base coat, separate base coaters and curing ovens are required. In addition, the conventional machines are not adapted for the highest quality of multi-color printing at high speeds because they are limited to laying down colors in a side-to-side relationship on the side walls of the two-piece cans.

It is known from the John Jackson U.S. Pat. No. 3,645,201 to provide a multi-color printing machine for cylindrical objects in which the rotating mandrels are indexed to printing and drying stations. In the Jackson machine the index table is horizontal and the mandrels are mounted horizontally; the ink is a volatile printing ink which uses hot air drying between color laydowns; the index table is rotated intermediately by an indexing mechanism and the mandrels are rotated by bevel gears. The use of volatile inks, the use of one station only for drying these inks, and the general machine configuration limits the speed of operation of the Jackson machine and thus affects its economic feasibility for two-piece can decorating.

In the machine described in Gladfelter U.S. Pat. No. 2,326,850 a metal can printing machine includes a can-support turret and a plurality of printing assemblies each including a transfer cylinder. The printing assemblies are driven by a large gear but the cans are not held on driven rotating mandrels. That machine has not been found to be commercially acceptable for present high-speed can manufacturing.

SUMMARY OF THE INVENTION

The decorator machine of the present invention decorates two-piece cans after they are formed into cylindrical shape. One way of feeding cans to the decorator is by an air pressure pipe and one way of removing them is by a vacuum pipe. The cans are placed on individual expandable supporting mandrels, which may hold the cans by vacuum coupled with the mandrel expansion and the mandrels are each continuously rotated. The mandrels are rotatably mounted in a vertically aligned index table which indexes them, in discrete steps, to in front of base coating, printing, top coating and ultra-violet radiation drying stations which are spaced between each of the coating and printing stations. All the stations are arranged around the periphery of the index table.

A motor, through a gear reducer unit, drives an indexing cam unit that has two output shafts. One shaft is caused to index by the indexing cam and the other shaft rotates continuously. The indexing shaft is connected to the mandrel carrying index table and causes the table to index to the coating, ink and ink drying stations. The continuously rotating shaft drives gears which in turn rotate a ring gear which is freely rotatably mounted on the indexing shaft, i.e., the shaft supporting the index table. The ring gear drives spur gears connected to the mandrels and also drives idler gears which drive the coating and printing rollers.

It is consequently an objective of the present invention to provide a decorating machine for the decoration of two-piece cans in which the consumption of energy required to coat, print and cure is decreased, the capital cost of the machine is substantially less than separate coaters, printers and ovens, the machine occupies a relatively small factory floor area, and yet the machine is capable of decorating such cans at a relatively high rate of speed and with a high quality of printing.

It is a further objective of the present invention to provide a machine for pictorial printing on two-piece cans wherein the print quality is comparable to three-piece can printing and wherein separate machines and ovens for base coating and top coating are not required.

It is a further objective of the present invention to provide a machine for applying an undercoating and for printing colors and an overcoating in one revolution of an index table and which will provide precise tolerances for the registration of the printing.

It is a still further objective of the present invention to provide such a machine in which both the mandrels and the index table are relatively simple in design and the mandrels are mounted at right angles to the index table, thus providing a relatively low moment of inertia as compared to other configurations and therefore permitting high index speeds; and the machine gear system is the type that is the simplest, and therefore the most economical, to produce.

It is still further objective of the present invention to provide rotating expandable mandrels on an index table, which mandrels are readily indexed for maintenance to a convenient location and which provide precise locked support for cans positioned thereon so that the cans may be printed with appreciable contact pressure, thereby providing for different types of printing methods such as dry offset, wet offset, gravure and flexographic.

It is a still further objective of the present invention to provide such a machine in which colors may be printed one on top of the other on the can, but the machine may be readily modified to rovide for side-by-side printing.

It is a still further objective of the present invention to provide for such a machine which will use non-volatile solventless inks and coatings which are quick drying, permitting the application of various colors one on top of the other and avoiding environmental difficulties due to the use of solvent inks and coatings.

It is a still further objective of the present invention to provide such a machine in which one method of feeding cans into the machine and the removal of cans from the machine is by air pressure and vacuum, which provides a rapid and secure feeding and removal means.

It is a feature of the present invention to provide a machine for the decoration of cans and similar objects which includes a circular index table which is vertically aligned and rotatably mounted to an indexing cam unit relative to a base. The machine further includes a plurality of mandrels, means rotatably mounting each of said mandrels on said table, and a spur gear affixed to each of said rotatable mounting means. The indexing cam unit comprises an input shaft from a motor to drive the unit, one continuously rotating output shaft and one intermittently rotating output shaft to which the circular index table is attached. A ring gear is independently supported by, but not attached to, this same output shaft. Motor means are mounted on the base and drive the ring gear from gearing attached to the continuously rotating output shaft of the indexing cam unit, and the ring gear drives the spur gears. A plurality of work stations are fixed to the base and arranged adjacent to the periphery of the index table and at least one of the stations includes a roller for the application of a material onto the cans, the roller being driven by the ring gear. The indexing cam unit indexes the index table in an intermittent repeated movement and dwell rotative movement. The index table, the ring gear and the mandrels are so sized that the index table and mandrels are driven in synchronism to precisely place the can support mandrel under each color for desired overlay printing designs.

It is a further feature of the present invention to provide such a machine in which the index means includes a vertically aligned dial (turret) fixed to the indexing cam unit. The indexing cam unit is rotatably mounted on the base and the index table is fixed to the intermittently rotating output shaft to which is attached a dial which supports a plurality of cam followers which are fixed and protrude from one face of the dial and the number of cam followers equals the number of mandrels. The cam followers are driven by a grooved cam and the grooved cam is rotatably mounted and rotated by the motor means. For example, the machine may include 30 mandrels and at least four printing stations, each printing station having a printing roller, and at least four drying stations, each drying station producing ultra-violet radiation.

BRIEF DESCRIPTION OF THE DRAWINGS

Other objectives and features of the present invention will be apparent from the detailed description of the present invention as set forth below, which provides the inventor's best mode of practicing the invention. The description should be considered in conjunction with the accompanying drawings, in which:

FIG. 5 is a side view of a mandrel;

FIG. 11 is a perspective view of an alternative form of an indexing cam mechanism which may be used in the machine of the present invention; and FIG. 12 is a front schematic view showing the arrangement of an alternative form of the machine of the present invention in which a plurality of cans are being decorated.

DETAILED DESCRIPTION OF THE PRESENT INVENTION

The machine of the present invention, as described in the following detailed description of the preferred embodiment, is specifically directed to printing decorations, such as pictures and words, directly on the cylindrical side wall of a two-piece can with precise printing registration. However, it will be understood that the machine may be adapted for the decorating of similar containers; for example, it may be used for the decorating of cups having cylindrical side walls and a bottom closure, or for the decoration of three-piece cans after they are formed into a cylindrical side wall having a closed bottom portion. In all cases, however, the general shape of the can being decorated is that it has a closed end, a cylindrical side wall and an open end, although the cylindrical side wall need not be a straight-walled cylinder but may be conically shaped. Each color is cured (dried) before the next color is applied, permitting colors to be laid one on top of the other and permitting a high quality of pictorial decoration.

Figure 1:
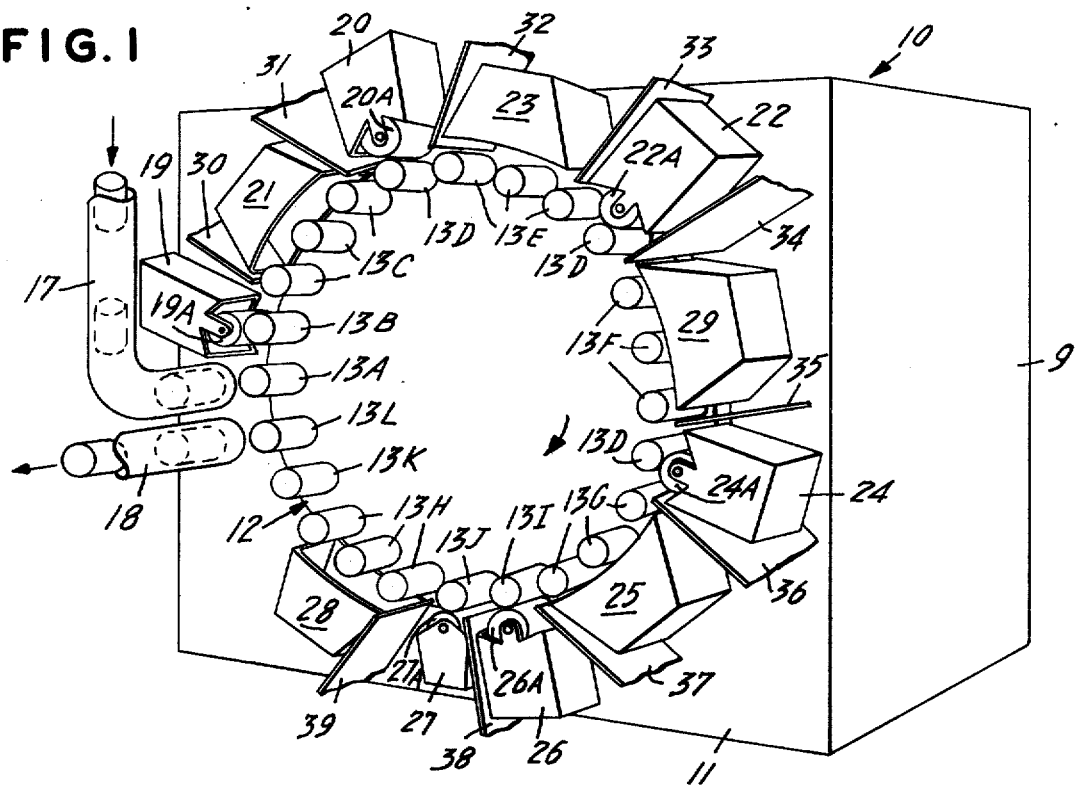
FIG. 1 is a front perspective schematic of the machine of the present invention showing a plurality of cans being decorated.

As shown in FIG. 1, the machine 10 of the present invention is particularly designed to afford a saving in space compared to the conventional machines, and will be about 7 feet wide, 6 feet long and 7 feet high. For that purpose the machine 10 may be enclosed in a rectangular cover 9 having a front face 11. An indexing table 12 (a circular turret) is rotatably positioned in front of the front face 11 and rotates about a central axis. The circular indexing table, as further described subsequently, is rotated in a 360° circle at an intermittent speed and with intermittent dwell and movement periods, i.e., a "stop and go" motion. It is preferable to rotate the index table in discrete forward and stop motions; for example, in an embodiment in which there are 30 equally spaced mandrels the index table 12 may be indexed in discrete 12° increments, such that it is stopped between each succeeding 12° station. A plurality of protruding mandrels 13A through 13L is rotatably mounted on the index table 12 near its outer circumference of the front face. Each of the mandrels 13A – 13L may be formed as a cylindrical post having a central axis about which each of the mandrels is rotated. The rotation of the mandrels 13A – 13L occurs continuously although the rotation of the index table 12 is intermittent. Consequently, a can positioned on a mandrel is continuously rotated about the axis of the mandrel upon which it is temporarily positioned and rotates, in discrete steps, about the center of the indexing table 12.

A plurality of work stations are fixed about the outer circumference of the indexing table 12. For convenience, the work stations may be mounted on the front face 11 of the cover 9, although alternatively they can be separately mounted on a separate bracket. The work stations include a first coating station 19 which coats the can with a layer of protective polymerizable plastic resin while the can revolves at least one revolution. The following listing of the work stations appears in the order in which they are arranged for clockwise rotation of the index table 12, as shown in FIG. 1, although by reversal of the entry and exit mechanism for the cans the direction of the index table and consequently the order in which the work stations operate upon the cans may be reversed, in which case the indexing table 12 would rotate in a counterclockwise direction. In either case, the mandrels 13A – 13L move with and in the same sense and direction as the rotation of the index table 12. However, the independent rotation of the mandrels proper may be clockwise or counterclockwise, depending on the rotation arrangement of the mandrel gearing.

The coating station 19 includes a source of coating material and a plurality of rollers, described subsequently, one of the rollers being coating roller 19A. The coating rollers, in the case of a righ-sided cylindrical can, which is the normal can shape, will be a right-sided cylinder which will contact the can for at least one revolution of the can. The coating roller may be larger in circumference than the can. The coating rollers will be driven in rotation at the same circumferential speed but in the opposite direction to the rotation of the can on the mandrel.

The 30-mandrel machine configuration provides for two base coating stations, with drying of the coating between stations, to insure good complete coating coverage.

The printing rollers may be larger in circumference than the cans. For example, a plate cylinder may pick up ink from the ink supply and transfer it to a printing roller, i.e., on the offset cylinder (blanket cylinder). The pressure between the printing roller and the can may be regulated by a controlled air supply which moves the axis of the printing cylinder toward or away from the axis of the mandrel in place in front of the printing cylinder. The can may make 1¼ complete revolutions under the printing station, but the actual can contact with the blanket cylinder is one revolution. The ¼ revolution overlap permits all indexing vibrations to cease prior to the blanket cylinder's contacting the can, which vibrations could adversely affect the printing quality.

After leaving the coating station 19, the cans are brought to in front of the open face of the ultra-violet dryer station 21. The ultra-violet dryer station 21 contains one or more electric lamps which produce electromagnetic radiation in the ultra-violet band. The ultra-violet radiation polymerizes and cures and dries the coating plastic resin applied by the coating station 19. For example, the plastic resin may be a thermosetting resin whose long-chain molecules are cross-linked by the effect of the ultra-violet radiation. Alternatively (not shown), the coating and ink may be heat-dryable and the drying stations may use high-temperature high-velocity air streams for drying.

As shown in FIG. 1, the ultra-violet dryer station 21 is constructed such that the width of its open face is slightly greater than the distance between the outside circumference of the three mandrels 13C. It is desirable to maintain a certain focal distance from the lamp to the can. Therefore, as shown in FIG. 1, because the can will intermittently stop under station 21 for three positions, three separate lamps may be desired. The three mandrels 13C positioned temporarily in front of it, which are shown in position in front of the ultra-violet station 21, are continuously rotated so that the cans temporarily positioned on the mandrels 13C will receive an equal amount of ultra-violet radiation upon each portion of their surface areas.

Subsequent to the ultra-violet dryer station 21 the cans are indexed to the first printing station 20 in which the can is revolved exactly one time in contact with the printing blanket. In the embodiment illustrated in FIG. 1 there are four printing stations 20, 22, 24 and 26, each of which can apply a different color and in each of which the can is revolved for one revolution in contact with each of the printing blankets. For example, printing station 20 may apply yellow, printing station 22 may apply blue, printing station 24 may apply red, and printing station 26 may apply black. As in conventional printing the four colors, by additive color combination, for all practical purposes, reproduce the entire spectrum of printing colors so that the decoration on the can may be in full color.

Alternatively (not shown), the indexing table 12 may be made smaller and fewer mandrels provided with fewer printing stations for a two-color printing process. As a further alternative, also not shown, the indexing table 12 may be made larger and additional printing stations added to provide special printing effects such as gold or silver in addition to the four-color printing.

Each of the printing stations 20, 22, 24 and 26 includes a source of colored polymerizable plastic resin which is coated onto the exterior surface of cans in a predetermined pattern. The exact overlapping of the patterns produces the colored printing and for that reason an exact synchronization of the movement of the index table and the correct rotational movement of the can support mandrels, along with the movement of the printing rollers, is required. If such synchronization is not obtained, there will be an undesirable lack of registration of the printing, which will result in blurred or distorted decoration.

The printing station 20 includes a printing roller 20A which is a right-sided cylinder and generally will have a larger circumference and diameter than the circumference and diameter of the can being decorated. The roller 20A rotates at the same speed but in the opposite direction from the rotation of the can positioned on the mandrel 13D. After leaving the first printing station 20 the cans are rotatably conveyed on the indexing table 12 until they stand in front of the second ultra-violet dryer station 23. The ultra-violet dryer station 23, and subsequent ultra-violet dryer stations 29, 25 and 28, are similar to the first ultra-violet dryer station 21. Each of the ultra-violet dryer stations has an open front face which is sufficiently wide so that the cans on three mandrels are exposed to the ultra-violet radiation produced within the ultra-violet drying stations. As in the case of the ultra-violet dryer station 21, the mandrels 13E, 13F, 13G and 13H, which are temporarily positioned respectively in front of the ultra-violet dryer stations 23, 29, 25, 28, are continuously rotated so that all surface areas of the cans positioned on the mandrels are evenly polymerized.

The cans, after leaving the ultra-violet station 23, are rotatably conveyed to the second printing station 22, then to the third ultra-violet drying station 29, then to the third printing station 24, and then to the fourth ultra-violet drying station 25, then to the fourth printing station 26, then to the coating station 27, and then to the final ultra-violet drying station 28. The coating station 27 applies a final covering coat of clear polymerizable plastic resin to protect the printing which is applied in the printing stations. The 24-station machine (shown in FIG. 1) shows the final coating being applied to the wet fourth printing laydown. An advantage of a machine with more stations, such as 30, is that a drying station can be inserted between the fourth color lay down and the final covering coat. Putting the final coat on top of a dry surface is a less critical operation as compared to putting in on a wet surface. It will be understood that the coating station 27 includes a coating roller 27A, the coating roller 27A being a right-angled cylinder having the same circumferential speed as that of the cans but being rotated in the opposite direction to the rotation of the cans on the respective mandrel 13J.

One method of positioning cans on the receiving mandrel 13A is by means of a pneumatic pipe 17 which conveys the cans from previous operations which include a forming machine (not shown) which has formed them into the container form, having a cylindrical side wall and an integral bottom closure. The pneumatic pipe 17 is connected to a source (not shown) of air pressure for conveying the cans and positioning them in timed relationship on the mandrel 13A.

One method of removing cans from the mandrel 13L is by the vacuum pipe 18 which is connected to a source of vacuum (not shown). The vacuum pipe 18 sucks the can from the top of the mandrel 13L and conveys it to the next operation and eventually to a packing machine (not shown). Each of the mandrels 13A through 13L receives a can from the pneumatic tube 17, conveys it in a circular direction to the various work stations, and then arrives underneath the vacuum pipe 18 for the removal of the can from its mandrel. The numbering of the mandrels is for convenience of explanation only, as it will be understood that each of the mandrels performs the entire sequence of receiving a can, conveying a can, rotating a can during conveyance, and positioning a can for removal.

As mentioned above, the preferred coating material and the preferred printing ink are thermosetting plastic resins which will dry rapidly under ultra-violet radiation. It is important that the ultra-violet radiation does not reach the plastic resin materials while they are on the printing blanket and coating rollers for, if the radiation reached the material, over time it may cause those materials to dry before they are coated on the can. Consequently, a set of shields 30–39 are arranged and positioned so that there is one shield between each of the ultra-violet lights and the coating and printing rollers. Those shields 30–39 permit the cans and mandrels to pass and prevent stray ultra-violet radiation, such as ultra-violet radiation reflected from the shiny and spinning cans from reaching the coating and printing rollers. The shields are thin sheet metal members which are fixed to the front face 11 of cover 9.

Figure 2:
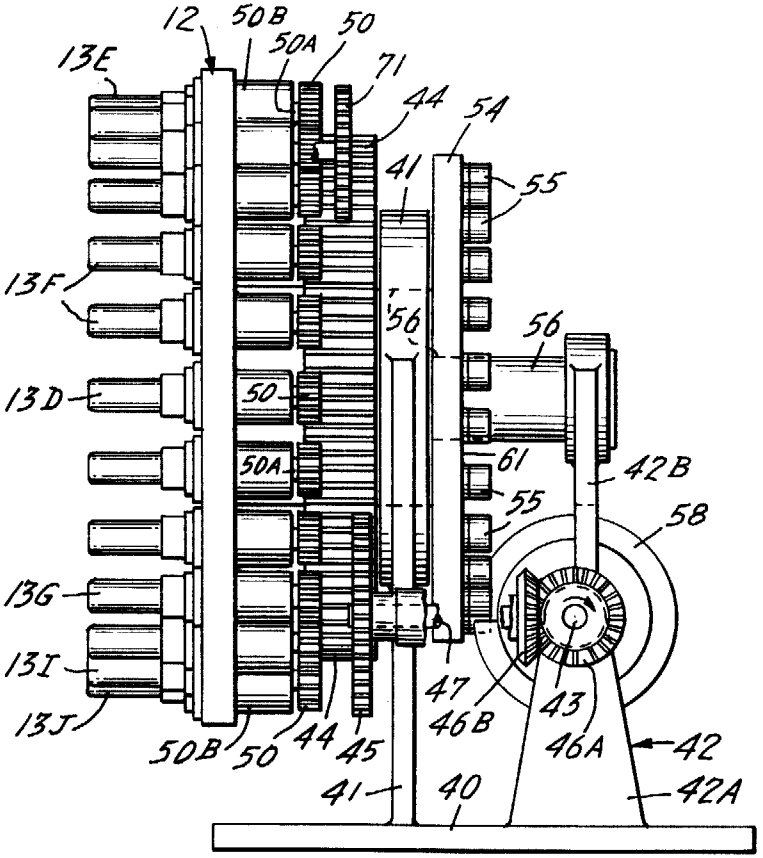
FIG. 2 is a side plan view of the machine of the present invention with the cover removed to show portions of its internal mechanism.

As shown in FIG. 2, the machine 10 includes a base 40 to which is mounted a vertically aligned support member 42 having support portions 42A and 42B. A second vertically aligned support member 41 is also mounted on the base 40 and is generally perpendicular to the alignment of the support member 42. An electric drive motor 59 is mounted on the support 42 and has a drive shaft 43 which is rotatably connected to drive an indexing cam 58. Although only a simple drive motor 59 is shown, it will be understood that the motor may be electrically controlled by a control panel to provide for various pre-selected speeds. Alternatively the electric motor 59 may drive a variable speed gear transmission which in turn would be connected to the drive shaft 43 and the speed of the machine may be varied by changing the variable speed transmission.

The shaft 43 which supports the indexing cam 58 is fixed to a first bevel gear 46A which is in mesh with a second bevel gear 46B.

The second bevel gear 46B is fixed to a shaft 47 which is rotatably turned by the shaft 43 but is at right angles thereto. The shaft 47 is rotatably mounted in bearings in a bracket connected to support 41 and has fixed thereto, at its end opposite to the gear 46B, a spur gear 45. The spur gear 45 is in mesh with the large gear ring (bull gear) 44. The teeth of the large ring gear 44 are in mesh with each of the small spur gears (mandrel gears) 50, there being as many spur gears 50 as there are mandrels.

Each of the spur gears 50 is fixed to a shaft 50A and each of the shafts 50A carries a mandrel 13 at its outer end, i.e., opposite to the end carrying the spur gear 50. The mandrels 13 provide the positioning support for the cans and are the same as the mandrels marked 13A through 13L, as shown in FIG. 1. Each of the shafts 50A is rotatably mounted in a housing 50B by bearings and each of the housings 50B is fixed to the index table 12. The centers of rotation of the axes of the mandrels 13 are equidistantly spaced around an imaginary circle, which circle is inboard from the outer circumference of the index table 12.

The movement of the index table is intermittent in order to provide adequate dwell-time for the application and drying, at each station, of the various coatings and printings. To provide such intermittent motion, the ring gear 44 is mounted so that it is freely rotatable to allow continuous motion on the intermittently rotating output shaft 56. The ring gear 44 is continuously driven by the drive shaft 43 which rotates the spur gear 45 at a constant speed. The intermittent motion of the shaft 56 is provided by an indexing cam unit. One form of an indexing cam unit consists of a set of rotatable cylindrical cam followers 55 provided in a circular equidistantly spaced array around the peripheral portion of the back face 61 of the circular rotatable turret 54. The turret (dial) 54 and the index table 12 are both fixedly mounted on the shaft 56 and intermittently rotate together as a unit. The intermittent rotative movement of the index table 12, shaft 56 and turret 54 is provided by sequential engagement of the cam followers 55 on the turret 54 by a cam track 57 in a continuously rotating cam 58 in the form of a cylindrical drum having the cam track 57 formed in the peripheral surface or rim thereof.

Figure 3:
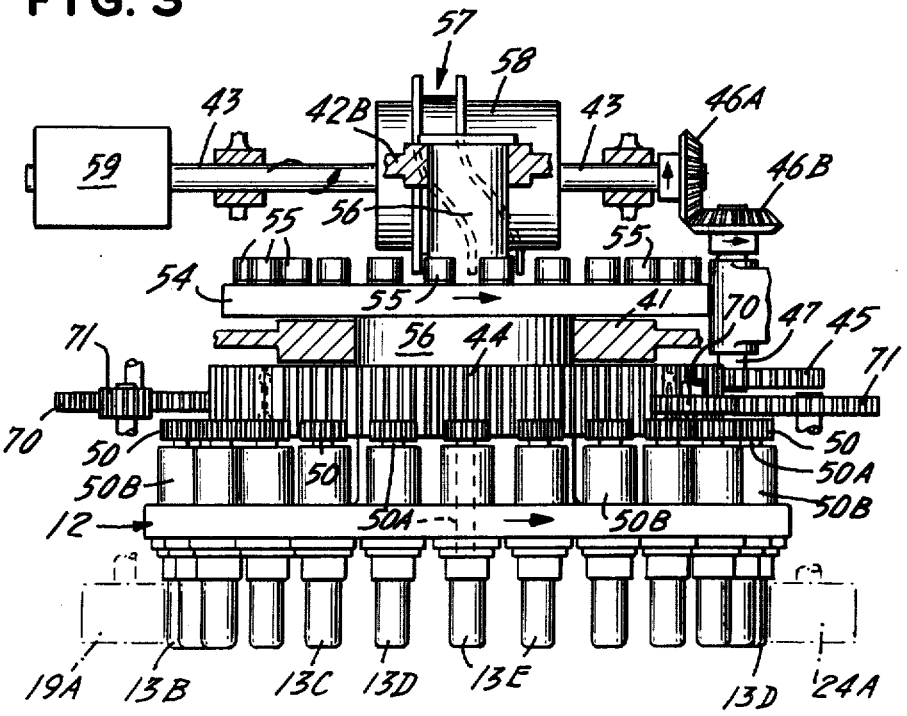
FIG. 3 is a top plan view of the machine of the present invention with its cover removed to show portions of the internal mechanism.

As illustrated in FIGS. 2 and 3 the drum cam 58 is mounted on the continuously rotating drive shaft 43 and is fixedly attached thereon to provide for continuous rotation. As illustrated in FIG. 3 the cam track 57 sequentially engaged individual cam followers 55 on the turret 54 to impart intermittent motion to the turret 54, shaft 56 and table 12. FIG. 3 illustrates the cam follower 55 about to be disengaged from the cam track 57 upon further rotation of the drum cam 58. The result is an intermittent motion of the turret 54 which allows adequate dwell time at each stage of the system. The cam 58 is capable of providing 300 indexing steps per minute. The cam track 57 forms an extending groove 360° about the rim of the cam drum 58, i.e., one complete rotation. The cam track (channel) 57 in the rim of the drum cam 58 is configured to impart the desired acceleration and deceleration characteristics of the index table 12. Depending on the cam design desired for example, the track can be angled relative to its axis of rotation to move the cam for 180° and for the remaining 180° the track can be straight to provide for the dwell period to cause the intermittent rotation of the turret 54, shaft 56 and table 12. Thus, for an equal angular index and dwell period at 300 cans per minute there is a 0.2 second cycle divided into 0.1 seconds of movement and 0.1 seconds of dwell.

The circular array of equidistantly spaced protruding cam followers 55 are mounted on the peripheral portion of the face of the turret 54. Depending on the design of the turret 54, the axes of the cam followers 55 can be in either a perpendicular relationship, as shown in FIG. 2, or a parallel relationship to the vertical face of the vertical turret 54. However, continuous rotational movement is provided to the mandrels 13 even while the turret 54 is in a stationary or dwell-time position because their spur gears are being continuously rotated by the continuous rotation of ring gear 44.

An alternative form of an indexing cam unit to index the index table is shown in FIG. 11. It consists of an indexing cam 160 which is fixedly mounted upon the continuously rotating shaft 43. The cam 160 has a groove which provides both sideways motion and rest motion to each of the cam followers 161 which are projections from the trial (turret) 162. The dial (turret) 162 is a direct replacement for the previously described turret 54 and would consequently have more cam followers than are shown in FIG. 5, FIG. 5 being for illustration of the principle of the cam mechanism. The output shaft 163, upon which dial 162 is fixed, is moved intermittently and the index table is fixed to the output shaft 163. In other words, the output shaft 163 is the same as the output shaft 56 in the other indexing cam unit previously described. This alternative type of indexing mechanism is available from the Ferguson Machine Company, Toledo, Ohio.

Figure 4:
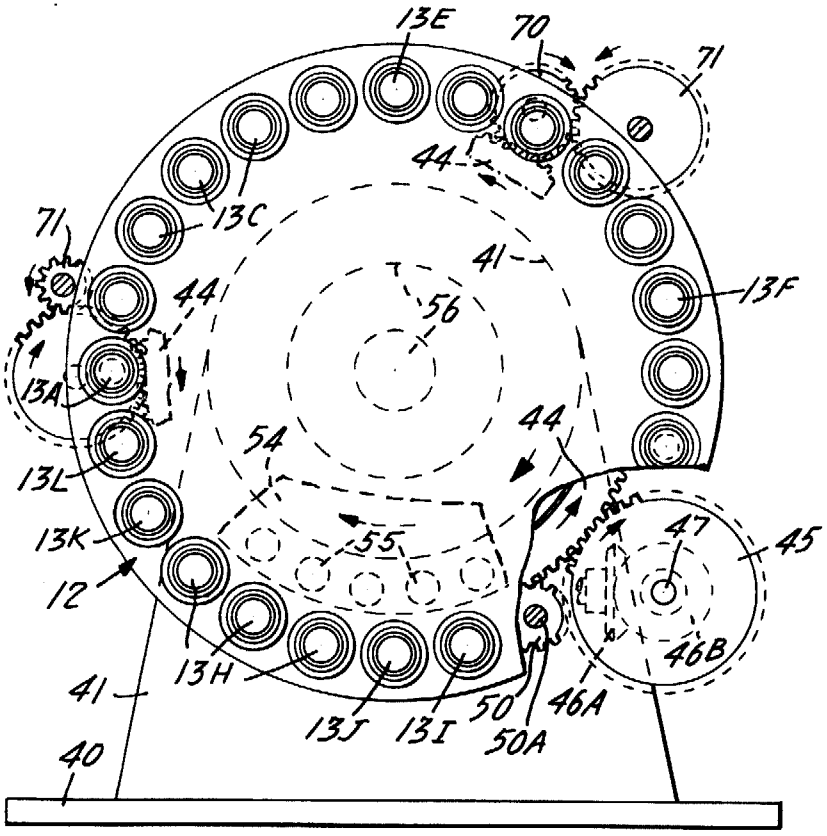
FIG. 4 is a front plan view of a machine of the present invention partly broken away to show partial cross-sectional views.

The ring gear 44, which is rotated by spur gear 45, also provides rotative power to the rollers of the coating and printing stations which are provided around the area adjacent the periphery of the index table 12. For example, the rotation of the printing cylinder 20A, as shown in FIG. 1, is provided in exact synchronism with the movement of the rotating mandrel 13D. A typical gear train for the printing and coating rollers is illustrated in FIG. 4 by the gear train which includes ring gear 44 which is in mesh with idler spur gear 70. The idler spur gear 70, rotatably mounted within printing station 20, is in mesh with a drive gear 71 which is fixed at one end of the cylinder 20A. As described above, the same ring gear 44 provides movement of the adjacent mandrels 13 through the spur gears 50. Similarly the cylinder 19A of the coating station 19, as well as the other cylinders 22A, 24A, 26A, 27A, is driven by a gear train including ring gear 44, a spur gear 70 and gear 71, all of which provide continuous movement to the cylinders in exact synchronism and speed as the rotation of the mandrels.

Each of the mandrels 13 is of the same size and construction. A workable design can be one of a number of variations. One design for the mandrels 13 is shown in FIGS. 5–10. The spur gear 50 is integral with a tube 80 which is rotatively mounted within sleeve housing 83. The housing 83 is integral with, or fixed to, the index table 12. A support member 84 is fixed to the index table 12 by its bottom flange and has a neck portion which supports the inner races of bearings 85. A tubular spindle 86 is rotatably mounted, by the bearings 85, on the neck portion of support member 84. The tubular spindle 86 has therein an opening 89 for connection at different times to vacuum or air pressure lines 81 to either hold the cans on the mandrel or blow the cans off the mandrel into the vacuum receiving pipe. The lines 81 are through a fixture 82 which is fixed and the movable index table brings the openings into line with the lines 81. A top cap 98 is fixed to the spindle 86. The spindle 86 is rotated by slide member 87 which is splined to shaft 88 so that it rotates with the rotation of shaft 88. The shaft 88 has an enlarged integral bottom shaft portion 88A which is held by clutch member 95. The shaft 88 rotates about its axis and is longitudinally slidable along its axis. A shaft 93 has a slidable clutch member 99 attached to one of its ends, terminates in a sealed knob 90, and rotates in tube 80. With the design shown, knob 90 is attached to slide 94 to which are attached cam rollers 96A and 96B. The slide 94 slides on sleeve housing 83. The cam rollers 96A contact a stationary cam 200 (see FIG. 5) which causes the shaft 88 to reciprocate as desired.

Figure 6:
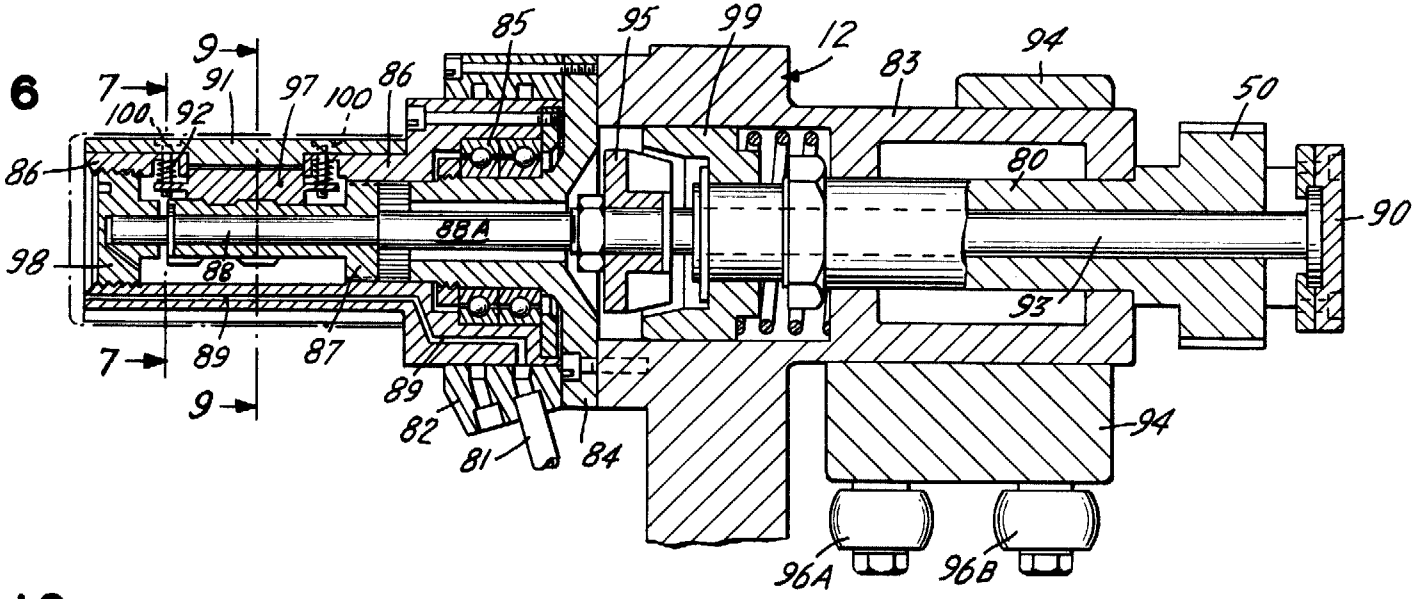
FIG. 6 is a cross-sectional view of the mandrel of FIG. 5 on an expanded scale.
Figure 8:
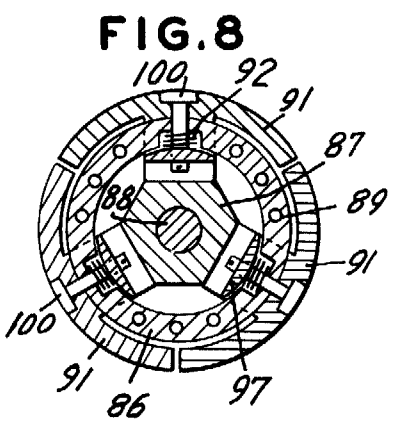
FIG. 8 is a view similar to that of FIG. 7 and showing the mandrel in its opened position.
Figure 9:
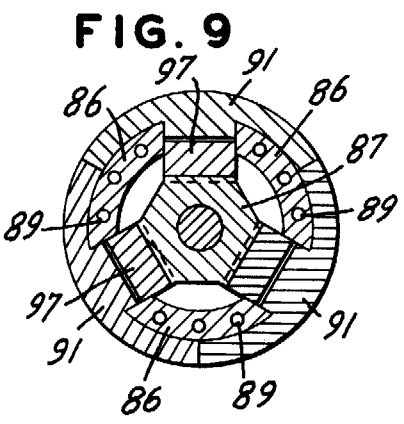
FIG. 9 is a cross-sectional view of the mandrel taken along the line 9—9 and looking in the direction of the arrows.
Figure 7:
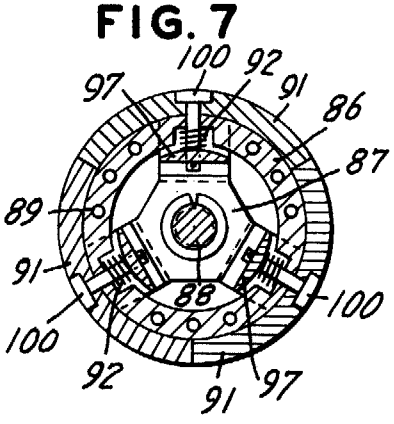
FIG. 7 is a cross-sectional view of the mandrel taken along line 7—7 of FIG. 6 and looking in the direction of the arrows and showing the mandrel in its closed position.
Figure 10:
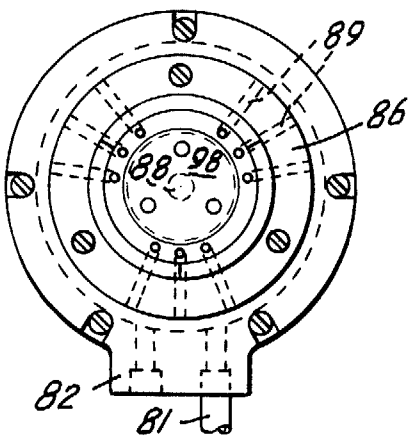
FIG. 10 is an end plan view of the mandrel.

The spindle 86 carries expandable members 91, preferably three in number, which, when closed, form a ring and which expand to hold the inner wall of the can and contract to release the can for free spinning on a coating roller or for removal by the vacuum pipe. Pins 100 going through expandable members 91 and through spindle 86 are attached to slide members 97 in a manner such that the pins 100 are free to vertically move in slide members 97. FIGS. 6 and 7 show expandable members 91 held in the contracted position by springs 92 which are located around pins 100. By withdrawing the shaft 88 toward index table 12, slide member 87 forces slide members 97 against expandable members 91 causing expandable members 91 to move out against the can. FIG. 8 shows the expanded position. The outward radial expansion pressure against the can of expandable members 91 is controlled by springs 92.

It is desirable to keep the expandable members 91 contracted during the entry of a can on the mandrel and the discharge of the can from the mandrel. It is vital that the expandable members 91 be expanded against the can during the transfer of the can from the first printing station to the last printing station in order to maintain precise printing registration. It is possible, and may be desirable, to keep the expandable members 91 contracted if no can is received on the mandrel to prevent the coating and printing heads from contaminating a bare mandrel. Also, with the design variation shown, the cone clutch 95 and 99 can be made to actuate under the coating stations, thus freeing the mandrel from being rotated by gear 50. Doing this causes the mandrel to be rotated by contracting the coater rollers. This might be desirable if more than one rotation under a coater roller is necessary for some coating materials or colors, particularly if only one base coating station is provided on the machine.

The above-described embodiment is of a 24-mandrel machine. However, another embodiment is of a 30-mandrel machine. The mechanism is generally the same as in the 24-mandrel machine except it has two base coat applying rollers to apply a first base coat and a second base coat, and a dryer for drying the cans between the two base coatings.

The 30-mandrel machine also utilizes expandable mandrels but the mandrel clutch mechanism can be eliminated because there are sufficient stations so that the can need not freely rotate under the base coatings.

An embodiment of a 30-mandrel machine of the present invention is shown in FIG. 12. The cans enter the machine and are carried from station to station by the rotary index table 101 which corresponds to index table 12. The mandrels 110 through 139 are rotatably mounted on the vertically aligned rotatable index table 101. As shown, the incoming can is placed on the mandrel 110 and, as the can is indexed, a first base coat is applied to the can which moves to mandrel position 111. That first base coat is dried when the can comes before the ultra-violet radiation dryer 141 which is positioned before the mandrels 112, 113 and 114. A second base coat is applied by the roller 142 to the can on the mandrel 115 and that second base coat is dried by the ultra-violet radiation dryer 143. A first color is applied by the printing mechanism 144 and is dried by the ultra-violet radiation dryer 145. Second, third and fourth colors are applied respectively by the printing mechanisms 146, 147 and 148 and are dried by the respective subsequent ultra-violet radiation dryers 149, 150 and 151. A top coating is applied by the coating roller 152 and is dried by the ultra-violet radiation layer 153. The cans are removed from the mandrel 139, for example, by the vacuum removing system described in the foregoing. A set of shields 170–182 is positioned so that there is a shield, as described in the foregoing, positioned between each ultra-violet radiation dryer and the printing or coating roller adjacent that dryer.

The machine of the present invention is well adapted for high-speed production in which 300 cans may be decorated in one minute. Many ultra-violet dryable inks and coatings are surface dryable in less than 0.5 second. The rate of 300 cans per minute allows 0.2 second for each index and dwell period. Thus, if three periods are allowed for setting each coating and color lay down, the drying time available for the final lay down is 0.6 second.

Modifications may be made in the present invention within the scope of the sub-joined claims. For example, instead of the first cure solventless ultra-violet dryable inks described above, other types of printing inks may be used (offset, gravure, or flexographic can be used), such as solvent inks. In that event the inks are not set with ultra-violet light but may use high velocity hot air. As with ultra-violet curable inks, the inks can be laid one on top of the other or can be laid side-by-side, which presents a more limited graphic display.

What is claimed is:

1. A machine for the decoration of cans and similar objects including a base a circular index table substantially vertically aligned and rotatably mounted relative to said base;

a plurality of mandrels, means rotatably mounting each of said mandrels on said index table, a spur gear affixed to each of said rotatable mounting means;

an index means having an intermittently movable output shaft to index said index table in an intermittent repeated movement and dwell rotative movement, said index means being driven by motor means;

a ring gear independently rotatably mounted on said intermittently movable output shaft, said motor means mounted on said base and driving said index means and said ring gear;

wherein said ring gear drives said spur gears;

a plurality of work stations fixed to said base and arranged adjacent to the periphery of said index table;

at least two of said stations including coating or printing rollers for the application of a material onto said cans, said rollers being driven by said ring gear;

at least two of said work stations being drying stations to dry the material applied on the can at the coating and printing stations;

whereby said index table and mandrels are driven in synchronism under each work station to achieve precise can registration.

2. A machine as in claim 1 wherein said index means includes a vertically aligned turret fixed to said intermittently movable output shaft, said index table is fixed to said output shaft, a plurality of cam followers are fixed and protrude from one face of said turret and whose number equals the number of mandrels, and a grooved cam is rotatably mounted to sequentially engage said cam followers, said cam being rotated by said motor means, wherein said grooved cam intermittently rotates said turret.

3. A machine as in claim 1 wherein said machine includes 30 mandrels and at least two printing stations, each printing station having a printing roller followed by at least one drying station between each coating and/or printing station, said drying stations producing ultra-violet radiation.

4. A machine as in claim 1 wherein each of said spur gears is in direct mesh with said ring gear.

5. A machine as in claim 1 wherein said motor means is a single electric motor having an output shaft, said output shaft drives a first bevel gear, a second bevel gear is in mesh with said first bevel gear, and said second bevel gear is carried by a shaft which also carries a gear which is in driving mesh with said ring gear.

6. A machine as in claim 1 wherein at least one of said stations includes an idler gear rotatably mounted on said base and in mesh with said ring gear, a roller fixed on a shaft, and a roller spur gear fixed on the same shaft as said roller, and wherein said idler gear is in mesh with and drives said roller spur gear.

7. A machine as in claim 1 wherein said roller is a coating roller and said ink and coating material are polymerizable resins and the drying stations produce ultra-violet radiation.

8. A machine as in claim 1 and further including a pneumatic pipe connected to a source of air pressure to deliver cans to the machine and a vacuum pipe connected to a source of vacuum to remove decorated cans from the machine, said pneumatic pipe having an exit orifice through which cans exit, said exit orifice being positioned adjacent a mandrel dwell position, said vacuum pipe having an entry orifice for the taking up of cans, said entrance orifice being positioned adjacent to said exit orifice and a mandrel dwell position.

9. A machine for the decoration of cans and similar objects including a base, a circular table substantially vertically aligned and rotatably mounted relative to said base;

a plurality of mandrels, means rotatably mounting each of said mandrels on said table, a spur gear affixed to each of said rotatable mounting means;

an indexing cam unit mounted on said base, a ring gear independently rotatably mounted on said indexing cam unit, motor means mounted on said base and driving said indexing cam unit and ring gear;

wherein said ring gear is in mesh with and drives said spur gears;

a plurality of work stations fixed to said base and arranged adjacent to the periphery of said index table, at least three of said work stations, each work station including an idler gear and a roller having a gear driven by said idler gear, said roller being for the application of a polymerizable resin material onto said cans, each of said idler gears being in mesh with and driven by said ring gear, at least three of said work stations being ultra-violet radiation drying stations;

an index means to index said index table in an intermittent repeated movement and dwell rotative movement, said index means including a vertically aligned turret fixed to said intermittently moving output shaft, said intermittently moving output shaft being rotatably mounted on said base, and said index table being fixed to said intermittently moving output shaft, a plurality of cam followers which are fixed and protrude from said turret and whose number equals the number of mandrels, and a grooved cam sequentially engageable with said cam followers is rotated by said motor means, said grooved cam intermittently rotating said dial, whereby said index table and mandrels are driven in synchronism.

10. A machine for the decoration of cans including a base, an indexing cam unit mounted on said base, a ring gear independently rotatably mounted on said indexing cam unit, motor means mounted on said base and driving said ring gear;

a circular index table vertically aligned and rotatably mounted on said indexing cam unit;

a plurality of mandrels, means rotatably mounting each of said mandrels on said index table, a spur gear affixed to each of said rotatable mounting means and driven by said ring gear and in mesh with said ring gear;

a plurality of work stations fixed to said base and arranged adjacent the periphery of said index table, at least three of said stations including a roller for the application of a polymerizable material onto said cans and an idler gear for driving said roller, said idler gear being in mesh and driven by said gear ring;

at least three of said stations being ultra-violet radiation drying stations; and an index means to index said index table in an intermittent repeated movement and dwell rotative movement.

11. A machine as in claim 10 wherein said index means includes a vertically aligned dial fixed to said indexing cam unit, said indexing cam unit is rotatably mounted on said base and said index table is fixed to said indexing cam unit, a plurality of cylindrical cam followers each having a central axis are fixed and protrude from one face of said dial with their axis either parallel or at right angles to the axis of said trunion and whose number equals the number of mandrels, and a grooved cam sequentially engageable with said cam followers is rotated by said motor means.

12. A machine as in claim 10 wherein said motor means is a single electric motor having an output shaft, said output shaft drives a first bevel gear, a second bevel gear is in mesh with said first bevel gear, and said second bevel gear is carried by a shaft which also carries a gear which is in driving mesh with said ring gear.

13. A machine as in claim 10 and further including a pneumatic pipe connected to a source of air pressure to deliver cans to the machine and a vacuum pipe connected to a source of vacuum to remove decorated cans from the machine, said pneumatic pipe having an exit orifice through which cans exit, said exit orifice being positioned adjacent a mandrel dwell position, said vacuum pipe having an entry orifice for the taking up of cans, said entrance orifice being positioned adjacent to said exit orifice and a mandrel dwell position.

14. A machine for the decoration of cans and similar objects including a base, a circular index table vertically aligned and rotatably mounted relative to said base;

a plurality of mandrels, means rotatably mounting each of said mandrels on said table, a spur gear affixed to each of said mandrels;

an index means mounted on said base and indexing said index table in discrete steps, a ring gear rotatably mounted on said index means, motor means mounted on said base and driving said ring gear and said index means;

wherein said ring gear is in mesh with and drives said spur gears;

a plurality of work stations fixed to said base and arranged adjacent to the periphery of said index table, each work station including application means for the application of a polymerizable resin material onto said cans, and drying work stations for drying said resin, which work stations are ultra-violet radiation drying stations, and a plurality of shields fixed to said base, each shield being positioned between an application means and a drying work station.

15. A machine as in claim 14 wherein shields are panel members positioned to allow passage of said cans and prevent said radiation from reaching said application means.

16. A machine as in claim 15 wherein said application means are rollers driven from said ring gear.

17. A machine as in claim 14 and further including a pneumatic pipe connected to a source of air pressure to deliver cans to the machine and a vacuum pipe connected to a source of vacuum to remove decorated cans from the machine, said pneumatic pipe having an exit orifice through which cans exit, said exit orifice being positioned adjacent a mandrel dwell position, said vacuum pipe having an entry orifice for the taking up of cans, said entrance orifice being positioned adjacent to said exit orifice and a mandrel dwell position.

* * * * *